US005421278A

United States Patent [19]

del Castillo

[11] Patent Number: 5,421,278

[45] Date of Patent: Jun. 6, 1995

[54] SEMI-AUTOMATED SEWING STATION

[75] Inventor: Fernando del Castillo, Brownsville, Tex.

[73] Assignee: Ideal Equipment Company, Ltd., Montreal, Canada

[21] Appl. No.: 131,603

[22] Filed: Oct. 5, 1993

[51] Int. Cl.[6] ..... D05B 21/00; D05B 75/00

[52] U.S. Cl. ..... 112/121.15; 112/258

[58] Field of Search ..... 248/180, 649; 112/121.15, 121.12, 102, 258, 260, 113, 114, 311, 217.1

[56] References Cited

U.S. PATENT DOCUMENTS

| | | | |
|---|---|---|---|
| 3,026,607 | 3/1962 | McNulty | 248/649 X |
| 3,216,678 | 11/1965 | Foedisch | 248/180 X |
| 4,278,031 | 7/1981 | Dangschat | 248/180 X |
| 4,498,404 | 2/1985 | Sadeh | 112/121.15 X |
| 5,000,103 | 3/1991 | Beermann | 112/121.15 X |
| 5,094,179 | 3/1992 | Badillo | 112/121.15 X |
| 5,272,994 | 12/1993 | Scholl et al. | 112/121.15 |

*Primary Examiner*—Clifford D. Crowder
*Assistant Examiner*—Paul C. Lewis
*Attorney, Agent, or Firm*—G. Turner Moller

[57] ABSTRACT

A semiautomated sewing station includes an improved frame in which the stationary bed of the x-y positioner is mounted directly on coplanar machined members. The x-y positioner has a vertically movable sewing clamp which eliminates angular readjustment of the clamps when they are changed. The x-y positioner also includes a redesigned sewing clamp arm which is considerably more rigid than the prior art arm and which allows very rapid stitching, even when moving the sewing clamp arm in a non-linear manner. A quick change sewing clamp and quick change workpiece preparation group, such as a folding group, allow the operator to change the operation of the device in a rapid, convenient manner.

6 Claims, 3 Drawing Sheets

SEMI-AUTOMATED SEWING STATION

This invention relates to a work station where sewing operations are conducted on shirt cuffs, collars, pockets and/or pocket flaps.

The manufacture of apparel has recently changed from a hand manipulated, machine sewing operation to a series of semiautomatic steps. This change has reduced the labor content of apparel so its manufacture has returned, to a significant extent, to the better developed countries from underdeveloped countries where labor costs are very low.

There are a wide variety of sewing tasks done on semi-automatic sewing stations including running and top stitching cuffs, collars and pocket flaps as well as setting pockets on shirt panels. Although these machines are different to accomplish their different functions, in many ways they are similar or identical. To a large extent, the features of this invention are usable on pocket setting machines as well as on cuff, collar and pocket flap machines. For purposes of illustration, a pocket setter is shown and described with the understanding that the techniques of this invention are usable on other types of semi-automatic sewing stations.

Prior art semi-automatic sewing stations normally use a welded tubular steel frame to which the various components are attached. The frames have evolved over the years and have become sturdier and more rigid without using substantially more material. For the last ten years or so, these tubular steel frames have included a series of planar surfaces or flanges at or below the mid-height of the frame which are machined to a predetermined level. Additional framework is bolted to the flanges to receive a cast aluminum bed on which an x-y positioner is attached. Modern x-y positioners provide a first pair of rails having a flat upper surface and perpendicular side surfaces including a pair of longitudinal grooves. A slide bearing runs on the rail. A movable bed is attached to the slide bearing and provides, e.g. the y-axis component of movement. A second set of rails and slide bearings connects to an arm providing, e.g. the x-axis component of movement.

Prior art semi-automatic sewing stations have a sewing clamp arm interconnecting the x-y positioner and the sewing clamp. Thus, the sewing clamp arm transmits movement of the x-y positioner to the sewing clamp. For a long time, the sewing clamp arm has been mounted for movement about a horizontal axis which moves the sewing clamp toward and away from the smooth table top on which the work slides. Thus, pivoting the sewing clamp arm provides a component of movement perpendicular to the x-y plane in which movement is controlled by the x-y positioner.

The pivoted sewing clamp arm of the prior art is somewhat long because of space restrictions and requirements. To keep its weight and inertia within reason, it can only be so large. Thus, the rigidity of the sewing clamp arm is the cause of a rather low limit on stitching speed when changing the direction of clamp arm movement. For example, the long straight sections of the junction between a pocket and the underlying shirt panel may be sewn at very high speeds, e.g. 4000 stitches per minute. In prior art pocket setters, stitching speed has to be slowed substantially at a right angled corner. For example, the triangular stitch pattern at the upper ends of many shirt pockets cannot be sewn much higher than 1000 stitches per minute because the stitch pattern is no longer triangular but instead is a distorted triangle having a curved upper side and rounded corners.

The prior art semi-automatic sewing stations made by the assignee of this invention include interchangeable sewing clamps and interchangeable workpiece preparation groups, such as folding groups.

One feature of this invention is a redesigned frame. Upon reflection and analysis, it has become apparent that many advantages accrue from replacing the bolted framework with more welded tubing and thereby raising the machined surfaces relative to the remainder of the frame. This eliminates the requirement to maintain vertical tolerances on the bolted framework which means the frame is easier and less expensive to manufacture and assemble and, at the same time, sturdier and more rigid.

Another feature of this invention is a vertically movable sewing clamp replacing the pivoted sewing clamp of the prior art. By mounting the sewing clamp for vertical movement perpendicular to the x-y plane, converting the machine from one operation to the next is simplified and much quicker. With the prior art pivoted arm, the connection between the sewing clamp and the sewing clamp arm requires angular adjustment because the sewing clamps used for different operations are of different size. With a vertically movable sewing clamp, no angular adjustment is needed because all movement is perpendicular to the x-y plane and it is immaterial how large the sewing clamp is. An ancillary advantage is provided because the motor providing vertical movement is much closer to the sewing clamp leading to better force control and less erratic movement of the sewing clamp.

Because of the vertically movable sewing clamp, it is now possible to redesign the sewing clamp arm and thus provide a more rigid connection at the end of the x-y positioner. As compared to the prior art pivoted sewing clamp arm, the clamp arm of this invention is much shorter and considerably wider so the sewing clamp is much closer to the main mechanism of the x-y positioner. This additional rigidity allows very high stitch rates at corners or in zig-zag patterns and keeps the stitches straight and the corners consistently at their designed angles.

Another feature of this invention is the provision of a quick change sewing clamp and workpiece preparation group, such as a folding group. A dovetailed shaped mortise is attached to the x-y positioner, in the case of the sewing clamp, and a mating dovetailed shaped tenon is attached to the sewing clamp. A double ended key hole slot is provided in the tenon. A motor carried by the mortise includes a movable output rod providing a pin designed to pass through either end of the key hole slot. The dovetailed connection provides excellent alignment so different folding groups and/or different sewing clamps may be used with a semi-automatic sewing station to change the type work being done.

It is an object of this invention to provide an improved semi-automatic sewing station.

Another object of this invention is to provide a semi-automatic sewing station having an improved frame.

A further object of this invention is to provide a semi-automatic sewing station having a sewing clamp arranged for simple vertical movement relative to its x-y positioner.

A still further object of this invention is to provide a semi-automatic sewing station having a redesigned sewing clamp arm allowing much higher stitching rates.

Another object of this invention is to provide means for readily replacing sewing clamps and workpiece preparation groups.

Other objects and advantages of this invention will become more fully apparent as this description proceeds, reference being made to the accompanying drawings and appended claims.

IN THE DRAWINGS

Figure 1:
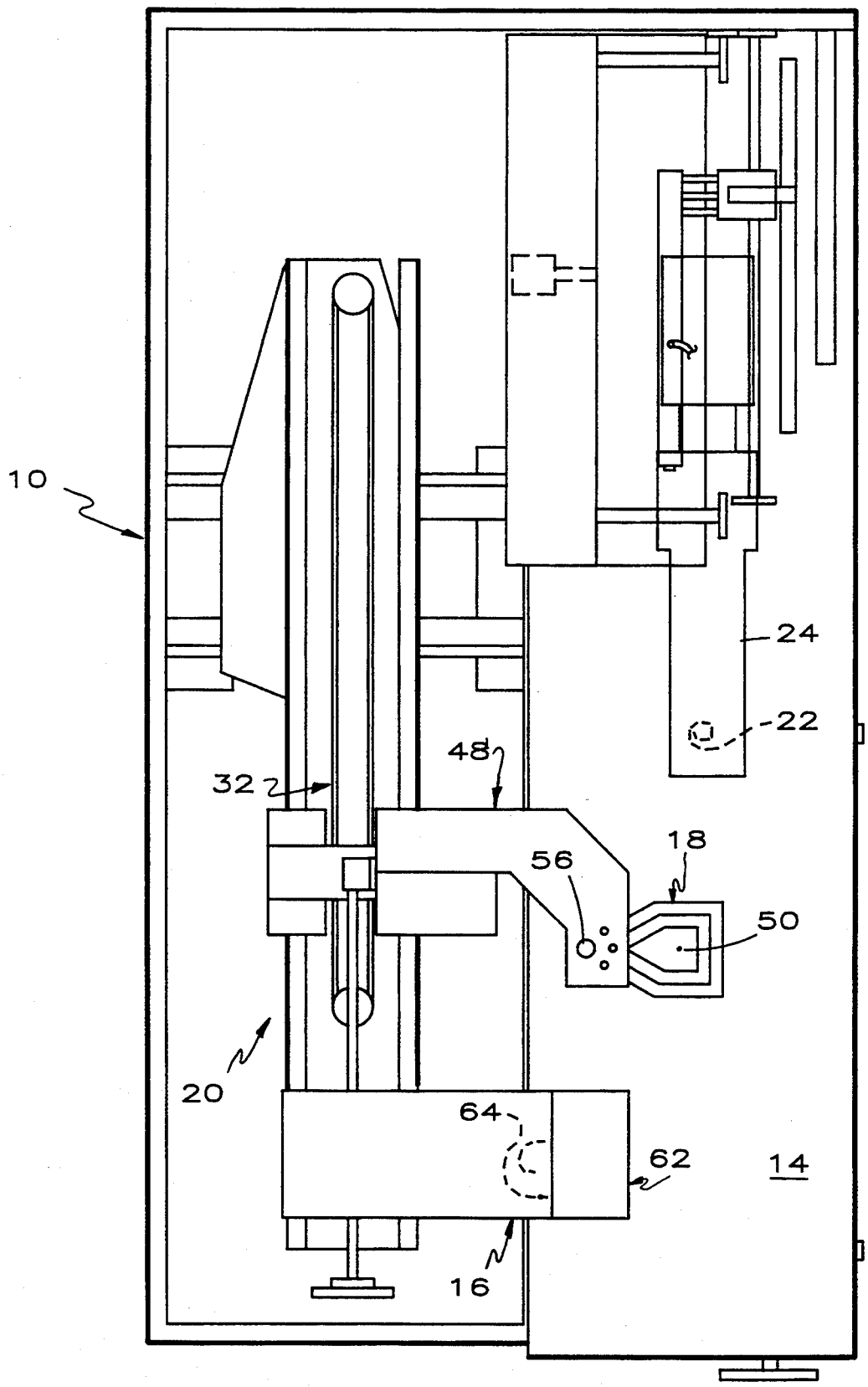
FIG. 1 is a top view of a pocket setter of this invention.
Figure 2:
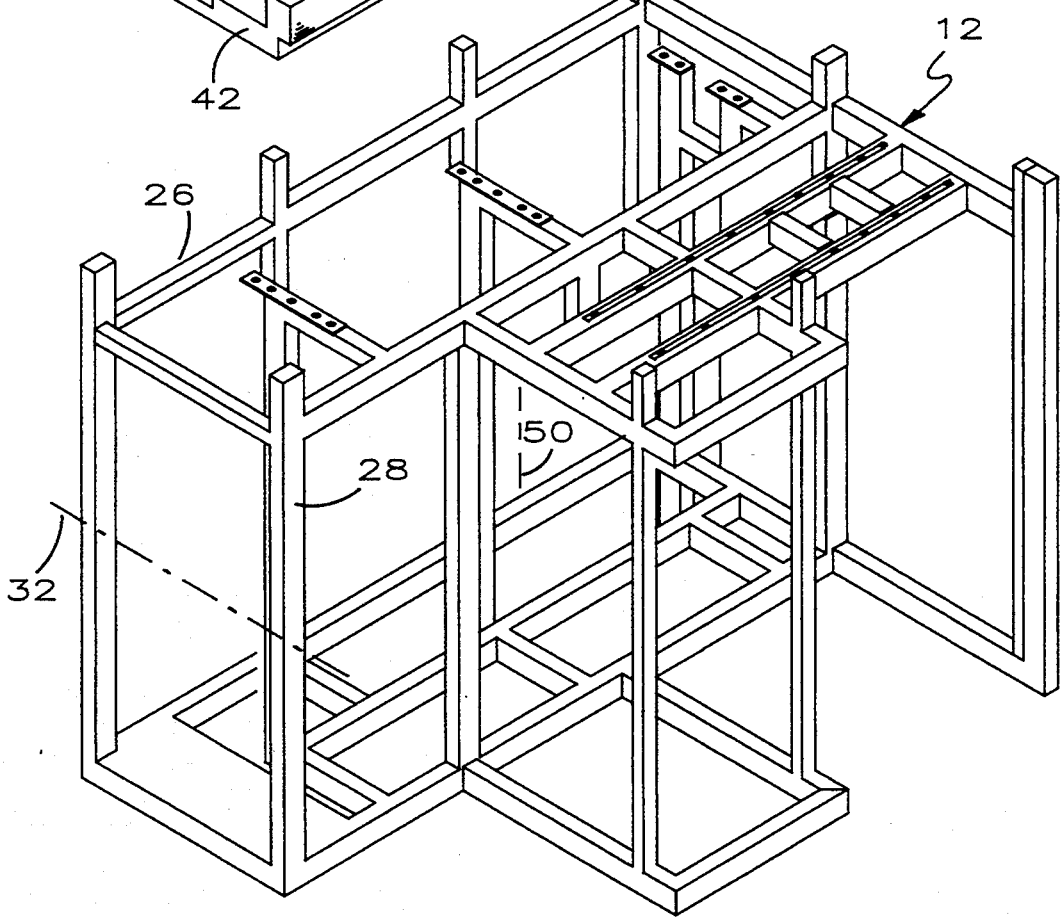
FIG. 2 is an isometric view of the improved frame of this invention, the upper and being broken away from the lower end for clarity of illustration
Figure 4:
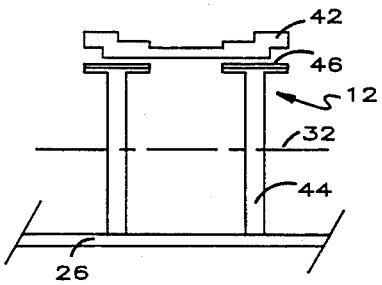
FIG. 4 is an end view of the frame of the pocket setter of this invention as viewed from the right side of FIG. 1.

Referring to FIGS. 1, 2 and 4, a pocket setter 10 of this invention comprises a frame 12, a smooth table top or working surface 14, a workpiece preparation group assembly which is a folding group assembly shown schematically at 16, a sewing clamp 18 and means 20 mounting the sewing clamp for movement between the folding group assembly 16 and a sewing location 22 provided by a sewing head 24.

The general plan of operation of one type of semi-automatic sewing stations is for an operator to place or prepare fabric blanks in the workpiece preparation group assembly 16. Upon command of the operator, the sewing clamp 18 moves to the workpiece preparation group assembly 16, presses the work against the smooth table top 14 and slides the work to the sewing location 22. While the sewing head 24 is stitching the work, the sewing clamp 18 moves the work in a predetermined pattern to provide the desired stitch pattern. Those skilled in the art will recognize this description as being exemplary of equipment made by the assignee of this invention, such as a Model 6855 Universal Stitcher, Models 6762 and 6862 Pocket Setters, Models 6824 and 6825 Cuff Runstitcher and Cuff Topstitcher and the like. For more information on the organization and construction of these machines, reference is made to appropriate publications of Ideal Equipment Company Ltd. of Montreal, Canada. The features of this invention are applicable to all such equipment although it is described in relation to a pocket setter.

Referring to FIGS. 2 and 4, the frame 12 is shown in more detail and comprises a welded framework of square steel tubing including a plurality of horizontal members 26 and a plurality of vertical tubing sections 28.

Figure 3:
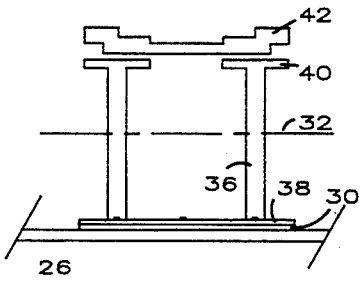
FIG. 3 (prior art)
FIG. 3 is an end view of the frame of a prior art pocket setter as viewed from the right side of FIG. 1.

FIG. 3 illustrates the frame of a prior art pocket setter providing a series of flat coplanar flanges 30 located in the bottom half of the frame below a horizontal mid-height plane 32, specifically about one-third of the distance from the floor to the table top 14. The flanges 30 are machined so the upper surfaces lie in the same plane. It is desirable that an x-y positioner 34, comprising part of the moving means 20, be parallel to the table top 14 and the machined upper surfaces of the flanges 30 comprise the bench mark for the x-y positioner 34. It will be seen that the x-y plane is parallel to the machined upper surfaces of the flanges 30. A series of columns 36 provide flanges 38 bolted to the flanges 30 and provide a set of upper connections 40 to which a cast aluminum bed 42 is bolted. The bed 42 carries the x-y positioner 34 which moves the sewing clamp 18 between the folding group assembly 16 and the sewing location 22 and then moves the sewing clamp 18 in a path at the sewing location 22 to produce the desired stitch pattern.

The improved frame 12 is illustrated in FIG. 4 and comprises the square metal tubing sections 26, 28 welded together into a rigid rectangular framework. Instead of the bolted columns 36, a pair of upright tubular frame members 44 extend upwardly and terminate in a series of flat plates 46 which are machined, in much the same manner as the flanges 30, to provide a bench mark for the x-y positioner. It will be seen that the x-y plane is parallel to the machined upper surfaces of the plates 46 and the cast bed 42 bolts to the plates 46. In effect, the difference between the prior art frame of FIG. 3 and the improved frame 12 of FIG. 4 is that the site of the machined elements constituting the bench marks has been moved from well below the mid-height plane 32 to well above the mid-height plane 32. Specifically, the machined elements have been moved from below the prior art columns 36 at a location about one-third of the distance from the floor to the table top 14 to a location about two-thirds of the distance from the floor to the table top 14. The advantage is that the height of the prior art columns 36 no longer has to be controlled to within a few thousandths of an inch. Any variation in the height of the tubular members 44 is accommodated by machining the plates 46. In addition, the members 44 are welded so there is no tendency of the members 44 to become loose as occasionally happens when the threaded fasteners securing the flanges 30 to the columns 36 loosen because of vibration.

An important feature of the invention is illustrated in FIGS. 1 and 5–7. In the prior art devices made by the assignee of this invention, the sewing clamp arm has been pivotally mounted from adjacent the x-y positioner 34 to provide a component of movement perpendicular to the x-y plane thereby allowing the sewing clamp 18 to move toward and away from the table top 14. This is necessary to press the work against the table top 14, slide it toward the sewing location 22 and then release the work.

According to this invention, and as shown in FIGS. 1, and 5–7, the sewing clamp 18 is mounted for movement relative to the sewing clamp arm 48 along a vertical axis 50 perpendicular to the x-y plane. This is accomplished by providing a pair of vertical guide pins 52 on the end of the sewing clamp arm 48, providing a pair of slide bearings 54 receiving the guide pins 52 and providing a linear air or electric motor 56 for sliding the sewing clamp 18 vertically as allowed by the guide pins 52. Mounting the sewing clamp 18 for vertical movement relative to the sewing clamp arm 48 provides several advantages. First, when changing sewing clamps on prior art machines, the rotational position of the sewing clamp on the sewing clamp arm has to be adjusted when the sewing clamps are of substantially different size. This is required because the sewing clamp is not perpendicular to the table top 14 except when very close to it. Second, in the improved arrangement, the force applied to the sewing clamp 18 is much easier to control and is much less erratic.

Mounting the sewing clamp 18 for vertical movement on the sewing clamp arm 48 has another important advantage because it allows redesign of the sewing clamp arm of the prior art. As shown best in FIGS. 1, 5 and 6, the distance from the end of the base 58 to the end of the extension 60 of the sewing clamp arm 48 is much shorter in the improved sewing clamp arm 48 of this invention. Thus, the sewing clamp arm 48 has a much greater moment of inertia and is thus much more rigid. This means the x-y positioner 34 can move the sewing clamp arm 48 much faster without shaking the sewing clamp 18 and thereby not distorting the stitch pattern sewn by the sewing head 24. Setting pockets with a prior art device requires that stitching slow down to a range of 1000–1200 stitches per minute when the sewing clamp arm changes direction frequently, as when sewing a triangular stitch pattern at the upper edge of pockets or when sewing a zig-zag pattern on pockets. This is necessary because the prior art sewing clamp arm flexes slightly causing the stitch pattern to be distorted. The sewing clamp arm 44 of this invention is capable of stitching at the rate of 3500 stitches per minute, rapidly change direction of the sewing clamp arm and still not distort the stitch pattern.

Figure 8:
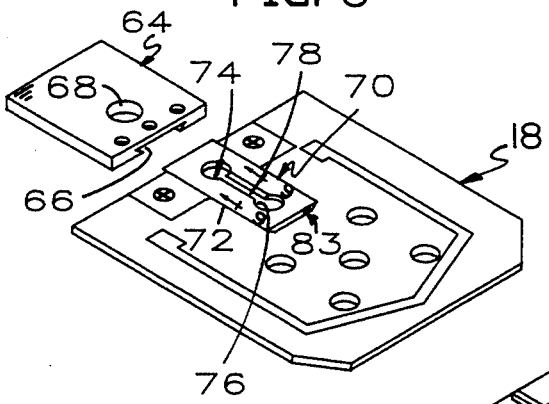
FIG. 8 is an enlarged exploded isometric view of the improved quick change feature of this invention.
Figure 9:
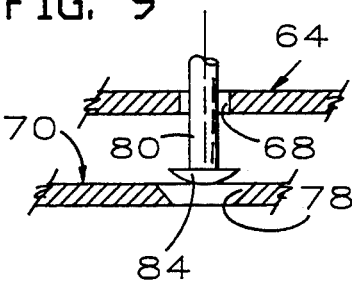
FIG. 9 is an enlarged cross-sectional view of FIG. 8, taken substantially along line 9—9 thereof, as viewed in the direction indicated by the arrows.
Figure 5:
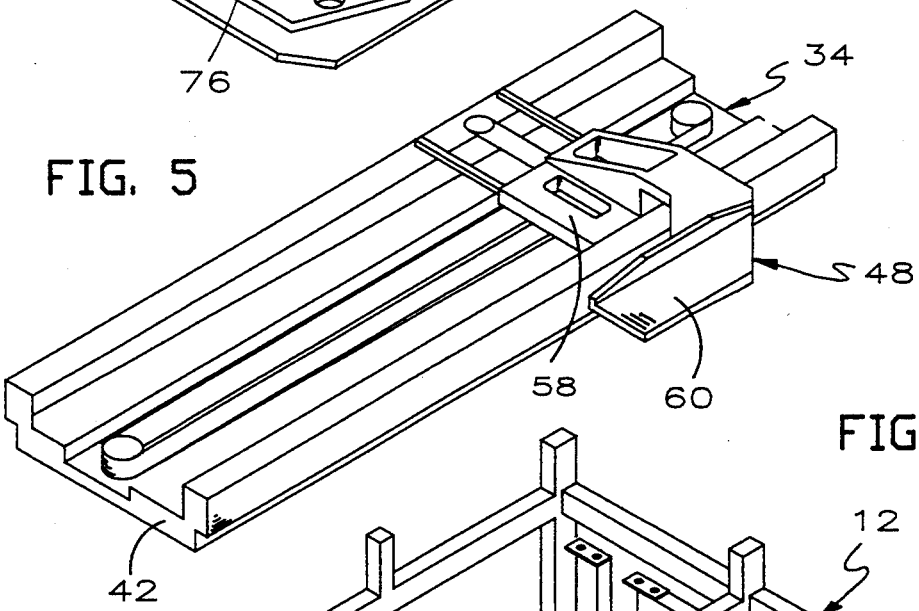
FIG. 5 is an isometric view of an x-y positioner incorporating an improved sewing clamp arm of this invention.
Figure 7:
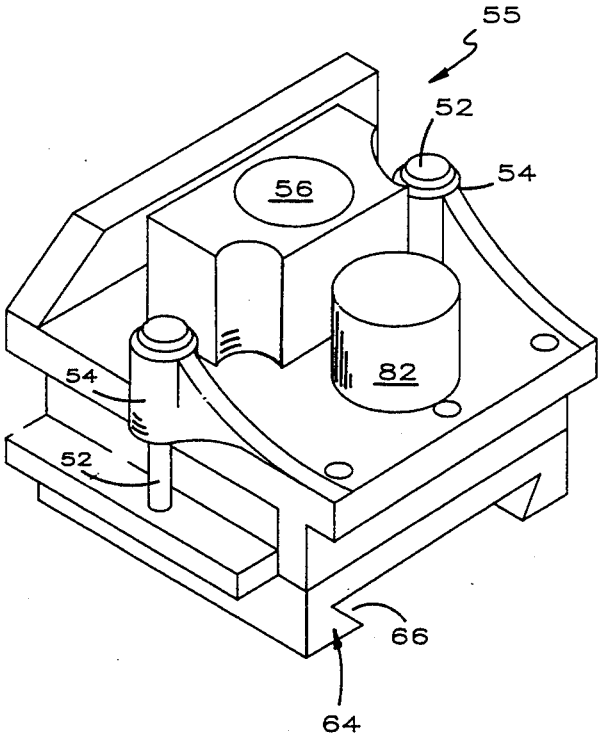
FIG. 7 is a partial enlarged isometric view of the end of the improved sewing clamp arm of this invention.
Figure 6:
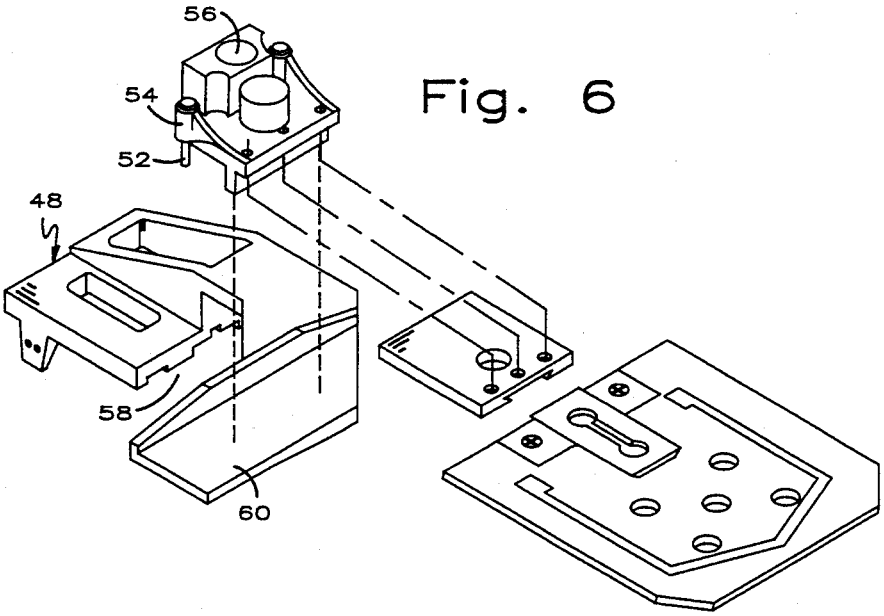
FIG. 6 is an exploded isometric view of an improved sewing clamp arm in its operative location on the x-y positioner, illustrating a quick change feature of the sewing clamp.

Another feature of this invention is shown in FIGS. 6–8. It is often desirable to provide a quick change feature for the sewing clamp 18 relative to the end of the sewing clamp arm 48 and for a folding group 62 relative to the end of the folding group assembly 16. This is particularly true with small manufacturers who need to frequently change the pocket styles being set on shirt panels.

To this end, a member 64 providing a dovetail mortise 66 is attached to the end of the sewing clamp arm 48 and/or to the end of the folding group assembly 16. The member 64 provides an opening 66 therethrough as will be apparent momentarily. A member 70 providing a dovetail tenon 72 is attached to the end of the sewing clamp 18 or to the end of the folding group 62. The member 70 provides a beveled double ended key hole slot 74 aligned with the opening 66. The key hole slot 74 includes a pair of oval beveled openings 76 and a central beveled slot 78. The output 80 of an air cylinder 82 extends through the opening 68 and provides a keyed end 84 small enough to pass through the openings 76 but large enough not to pass through the slot 78. With the output 80 retracted, the dovetail tenon 70 slides easily into the mortise 66. When the output 80 is extended, the keyed end 84 centers in the bevel of the slot 78 and causes the tenon 70 to fit precisely in the mortise 66.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A sewing station comprising a frame having a bottom, a table top mounted on the frame and having a generally planar surface, a workpiece preparation group for receiving fabric blanks and positioning the blanks on the planar surface in a predetermined position, a sewing head having a reciprocable sewing needle defining a sewing location on the table, a sewing clamp for pressing the fabric blanks against the planar surface and an x-y positioner carried by the frame for moving the sewing clamp between the workpiece preparation group and the sewing location for sliding the fabric blanks from the workpiece preparation group to the sewing location, the frame having a predetermined height and comprising a plurality of parallel first frame members, a plurality of second frame members perpendicular to the first frame members, weldments securing the first and second frame members in a rigid shape and a plurality of coplanar elements having upwardly facing machined sides providing a bench mark for the x-y positioner, the x-y positioner comprising a stationary bed affixed to the machined coplanar elements, the improvement wherein the upwardly facing machined sides and bench mark are located above a first horizontal plane parallel to the table top, the first plane being midway between the frame bottom and the table top.

2. The sewing station of claim 1 wherein the stationary bed is attached directly to the machined sides of the coplanar elements.

3. A sewing station comprising a frame, a table top mounted on the frame and having a generally planar surface, a workpiece preparation group for receiving fabric blanks and positioning the fabric blanks on the planar surface in a predetermined position, a sewing head having a reciprocable sewing needle defining a sewing location on the table, a sewing clamp for pressing the fabric blanks against the planar surface and an x-y positioner carried by the frame for moving the sewing clamp between the workpiece preparation group and the sewing location for sliding the fabric blanks from the workpiece preparation group assembly to the sewing location, the improvement wherein the x-y positioner comprises a sewing clamp arm moved in a first plane defined by the x-y positioner;

means carried by the sewing clamp arm for moving the sewing clamp linearly along a vertical axis perpendicular to the first plane; and means connecting the sewing clamp arm and the sewing clamp for removing the sewing clamp from the sewing clamp arm along a horizontal axis perpendicular to the vertical axis.

4. The sewing station of claim 3 wherein the sewing clamp arm comprises a plurality of vertical guide pins, a bracket providing a plurality of slide bearings receiving the guide pins and means for moving the bracket relative to the sewing clamp arm, the sewing clamp being connected to the bracket, the bracket providing a horizontal passage for removably receiving the sewing clamp.

5. The sewing station of claim 4 wherein the horizontal passage is a dovetail mortise, the sewing clamp comprising a tenon received in the mortise.

6. The sewing station of claim 3 wherein the connecting means comprises a dovetailed mortise, a mating dovetailed tenon providing an elongate slot and means for binding the tenon in the mortise.

* * * * *